US012325559B2

(12) United States Patent
Arunas

(10) Patent No.: US 12,325,559 B2
(45) Date of Patent: Jun. 10, 2025

(54) CLOSURE DEVICE

(71) Applicant: UAB Baltic caps, Panevezys (LT)

(72) Inventor: Matulis Arunas, Panevezys (LT)

(73) Assignee: UAB Baltic caps, Panevezys (LT)

( * ) Notice: Subject to any disclaimer, the term of this patent is extended or adjusted under 35 U.S.C. 154(b) by 0 days.

(21) Appl. No.: 18/140,479

(22) Filed: Apr. 27, 2023

(65) Prior Publication Data

US 2024/0217707 A1 Jul. 4, 2024

(30) Foreign Application Priority Data

Jan. 3, 2023 (EP) ..... 23150161
Jan. 25, 2023 (EP) ..... 23153273

(51) Int. Cl.
*B65D 41/34* (2006.01)
*B65D 1/02* (2006.01)
(Continued)

(52) U.S. Cl.
CPC ..... *B65D 41/34* (2013.01); *B65D 1/023* (2013.01); *B65D 47/06* (2013.01); *B65D 53/02* (2013.01)

(58) Field of Classification Search
CPC ..... B65D 53/04; B65D 53/00; B65D 53/02; B65D 41/045; B65D 41/348; B65D 41/3428
(Continued)

(56) References Cited

U.S. PATENT DOCUMENTS 1,552,525 A * 9/1925 Westerbeck ..... B65D 41/0492 220/284
1,881,529 A * 10/1932 Hammer ..... B65D 41/3485 215/256
(Continued)

FOREIGN PATENT DOCUMENTS

EA 200501334 A1 4/2007
FR 2217231 B1 9/1974
(Continued)

*Primary Examiner* — Steven A. Reynolds
*Assistant Examiner* — Prince Pal
(74) *Attorney, Agent, or Firm* — MARSHALL, GERSTEIN & BORUN LLP

(57) ABSTRACT

The invention relates to closure devices with opening indication element for bottles with a threaded neck. The closure device for bottle having a neck, comprising a pour sleeve (10) made with the ability to be installed on the neck, a closed sleeve (1) with means of fixation on the pour sleeve (10), a sealing means (11), an open sleeve (3) and an indicator ring (5), wherein the closed sleeve (1) and the open sleeve (3) form a cavity (4), and the indicator ring (5) is provided with an annular belt (6) placed in said cavity (4) before the first opening. The annular belt is made with the ability to be released from said cavity during the first opening and preventing the return of the indicator ring to its initial position when closing the bottle again. In another embodiment, the open sleeve can form a cavity with the closed sleeve (1), as well as an indicator ring (5) with annular belt (6) placed in the cavity (4) with the ability to be released during the first opening and preventing the indicator ring (5) from returning to its initial position when the bottle is closed again. Technical result of the invention is increased reliability and security of the closure cap indicating any opening by improving the visual indication of opening of the bottle and strengthening the protection against its bad-faith reuse.

12 Claims, 3 Drawing Sheets

(51) Int. Cl.
*B65D 47/06* (2006.01)
*B65D 53/02* (2006.01)

(58) Field of Classification Search
USPC ..... 215/230, 200, 252, 901
See application file for complete search history.

(56) References Cited

U.S. PATENT DOCUMENTS 2,130,746 A * 9/1938 Scofield ..... B65D 41/3485 215/350
3,664,536 A * 5/1972 Emery ..... B65D 51/18 215/277
3,796,338 A * 3/1974 Wilton ..... B65D 41/348 215/252
3,930,588 A * 1/1976 Coursaut ..... B65D 41/348 215/253
4,395,446 A * 7/1983 Kunimoto ..... B65D 41/12 428/416
4,415,096 A * 11/1983 Ohmi ..... B65D 53/04 215/343
4,540,100 A * 9/1985 Willis ..... B65D 49/04 215/28
5,064,084 A * 11/1991 McBride ..... B65D 41/045 215/350
6,817,479 B1 * 11/2004 Ferry ..... B65D 41/045 215/354
7,394,383 B2 * 7/2008 Hager ..... B65D 51/245 340/572.1
7,832,577 B2 * 11/2010 Shingle ..... B65D 50/043 215/217
8,453,856 B2 * 6/2013 Skelton ..... B65D 41/62 215/230
9,010,554 B2 * 4/2015 McPherson ..... B65D 50/00 215/230
10,669,075 B2 * 6/2020 Robles González ..... B65D 41/348
10,842,713 B1 * 11/2020 Cohen ..... A61J 7/0046
2004/0155007 A1 * 8/2004 Hearld ..... B65D 41/045 215/349
2005/0211657 A1 * 9/2005 Mallet ..... B65D 41/3428 215/349
2007/0095781 A1 * 5/2007 Wan ..... B65D 41/0492 215/276
2007/0138125 A1 * 6/2007 Granger ..... B65D 41/348 215/349
2007/0158295 A1 * 7/2007 Lohrman ..... B65D 55/02 215/252
2007/0289934 A1 * 12/2007 Gancia ..... B65D 51/1677 215/256
2008/0073309 A1 * 3/2008 Nakajima ..... B65D 41/348 215/252
2008/0190883 A1 * 8/2008 Macchi ..... B65D 41/62 215/364
2008/0251491 A1 * 10/2008 Krautkramer ..... B65D 51/244 29/527.3
2008/0264893 A1 * 10/2008 Battegazzore ..... B65D 41/348 215/252
2008/0272086 A1 * 11/2008 Granger ..... B65D 41/348 215/354
2011/0253666 A1 * 10/2011 Keller ..... B65D 41/045 215/350
2015/0135508 A1 * 5/2015 Ichimura ..... B21J 5/00 29/437
2015/0251820 A1 * 9/2015 Glaser ..... B65D 41/3447 220/288
2017/0137188 A1 * 5/2017 Tsuchiya ..... B29C 43/003
2018/0354689 A1 * 12/2018 Weir ..... B65D 55/026
2019/0359398 A1 * 11/2019 Shimoji ..... B65D 41/34
2020/0047956 A1 * 2/2020 Bottger ..... B65D 53/02
2020/0165041 A1 * 5/2020 Bottger ..... B65D 51/145
2020/0216227 A1 * 7/2020 Araki ..... B29C 45/1671
2020/0324941 A1 * 10/2020 Ross ..... B65D 41/349
2020/0346812 A1 * 11/2020 Bueti ..... B67B 3/20
2022/0250814 A1 * 8/2022 Fujishige ..... C09D 167/00
2024/0217707 A1 * 7/2024 Arunas ..... B65D 47/06

FOREIGN PATENT DOCUMENTS

RU 2223209 C2 2/2004
RU 191981 U1 8/2019
WO WO-02083518 A1 * 10/2002 ..... B65D 49/04

* cited by examiner

CLOSURE DEVICE

CROSS-REFERENCE TO RELATED APPLICATION

The present application claims priority to European Application No. 23150161.0, filed Jan. 3, 2023, and European Application No. 23153273.0, filed Jan. 25, 2023. Each of the priority applications, EP23150161.0 and EP23153273.0, is hereby incorporated by reference in its entirety.

The invention relates to closure devices with opening indication element for bottles with a threaded neck, intended primarily for liquid products, such as spirits.

In order to use opening indication in order to warn about tampering, various types of caps use a strip that remains on the bottle when the main part of the cap is unscrewed. Such a closure device is disclosed, for example, in French patent FR2217231 B1, and it is a cap for closing a bottle, equipped with a threaded element for installation on the neck of the bottle and containing an indication means, which is the lower part of the cap, separated from the main part by a perforation forming breakable bridges. When the cap has been unscrewed, the breakable bridges are destroyed and the strip separated from the cap falls down onto the neck of the bottle, preventing the cap from returning to its initial shape, thus signaling that the bottle has been opened.

The disadvantage of this known closure means is that with this design, the strip can be hidden under the main cap or removed from the neck by tearing the strip.

This disadvantage is partially eliminated in the technical solution according to the patent of the Russian Federation RU2223209 C2, in which the closing of a container with alcoholic beverage, usually a bottle with a neck having a thread and an annular flange, is done through a closure cap, equipped with closure means and tamper-evident means and containing two assembled together parts rigidly connected both in the direction of rotation and in the axial direction. As indicator means, an indicator belt is used, made in the form of a separate annular part, located in the lower part of the closure cap and connected to the screw cover by bridges. The indicator belt contains an inner rim provided with engaging means, which are tabs facing inside the closure cap, fixed under the annular flange of the bottle neck. In the process of opening the cap, the bridges are destroyed, the indicator belt becomes visible, and the ability of its snapping under the annular flange of the bottle prevents its reconnection with the cap and makes it difficult to easily remove it from the neck. The disadvantage of this known technical solution is the weak protection of the closure cap from accidental opening, because the connection of the indicator element with the cover of the cap by bridges is not reliable enough and can be destroyed before the first opening of the bottle both at the stage of capping and during transportation of products with such a cap to the consumer, which reduces the reliability of such an indication.

From the publication of the application for the Eurasian patent EA200501334 A1, a closure cap for a bottle with neck having a thread and an annular flange, containing a screw cover, a shell covering the cover, which is made with the ability of its lower part to go behind the annular flange, as well as an indicator belt made along the lower contour of the cover with the ability of release from under the breaks of the shell, is known. When the cap is unscrewed, the belt is destroyed, and its visible parts appear, signaling the first opening, and when the cap is screwed again on the neck, the indicator belt released from under the shell remains outside between the joined edges of the cap shell. The disadvantage of this known technical solution is that when the bottle is closed again, the cap moves up by the amount of the released indicator belt, which does not ensure the tightness of the bottle upon reclosure, and also that the destruction of the belt by the rolled edges of the shell does not always occur, because it is part of the cover, and the radial force action does not lead to its rupture, but the belt remains firmly attached to the cover.

The closest analogue of the present invention is the closure cap for a bottle with a threaded neck disclosed in Russian Federation patent RU191981, which comprises a screw cover, a shell, an indicator belt made along the lower contour of the cover with the ability of release from under the shell. According to the mentioned patent, the indicator belt is installed between the inner part of the shell and the outer surface of the annular element located in the lower inner part of the shell, wherein on the outer surface of the shell at the location of the indicator belt, a line of weakened strength is made. The disadvantage of such a closure cap is that the release of the belt from under the lower part of the shell indicates the opening of the bottle, but does not guarantee protection against reuse, because it is possible, by removing the cap from the bottle, to replace its contents and to hide again the indicator belt under the lower edge of the shell.

The object of the present invention is to improve the means of visual indication of the opening of a closure device of a bottle by adding an additional element to the design of the device, which can be released upon first opening, and which prevents the indicator ring from returning to its initial position when the bottle is closed again.

The technical result, which is achieved in this case, is to increase the reliability and security of the closure device, indicating any opening by improving the visual indication of opening of the bottle and strengthening the protection against its bad-faith reuse.

The object and specified technical result are achieved by closure device for bottle, having a neck, comprising a closed sleeve, a sealing means, an open sleeve and an indicator ring, wherein the closed sleeve and the open sleeve form a cavity, and the indicator ring is provided with an annular belt, placed in said cavity before the first opening, and the annular belt is made with the ability to be released from said cavity during the first opening and preventing the return of the indicator ring to its initial position when the bottle is closed again.

In a first embodiment of the closure device, the device has a closed sleeve, a sealing means installed on the neck of the bottle, an open sleeve and an indicator ring, wherein the closed sleeve and the open sleeve form a cavity, and the indicator ring is provided with an annular belt, placed in said cavity before the first opening, and the annular belt is made with the ability to be released from said cavity during the first opening and preventing the return of the indicator ring to its initial position when the bottle is closed again.

The annular belt of the indicator ring can be made continuous or discontinuous.

Preferably, the sealing means is in the form of a gasket, the diameter of which is sufficient to cover the bottle neck finish.

Preferably, the sealing means is made in the form of a gasket with an annular collar placed in the neck of the bottle.

In a second embodiment of the closure device for bottle, the device has a neck, comprising a pour sleeve, made with the ability to be installed on the neck, a closed sleeve with means of fixation on the pour sleeve, a sealing means, an open sleeve and an indicator ring, wherein the closed sleeve and the open sleeve form a cavity, and the indicator ring is provided with an annular belt, placed in said cavity before the first opening, and the annular belt is made with the ability to be released from said cavity during the first opening and preventing the return of the indicator ring to its initial position when the bottle is closed again.

Preferably, the sealing means is in the form of a base placed in the neck of the bottle.

Preferably, the closure device comprises an outer casing at least partially enclosing the closed sleeve.

For all embodiments of the device, implementing the indicator ring with an annular belt as a separate element, as well as its placement in the cavity between the closed sleeve and the open sleeve, contributes to the reliable release of the indicator belt during the first opening and prevents the indicator ring from returning to its initial position when the bottle is closed again. This eliminates unintentional or intentional movement of the indicator ring after the first opening of the closure device to a position corresponding to the position of the indicator ring before the first opening of the closure device, providing increased reliability and security of the closure device in comparison with known analogues, including the closest analogue. At the same time, the presence of a sealing means ensures the tightness of the bottle when it is reclosed, which is a prerequisite for the use of the claimed closure device and its similar devices.

In a particular embodiment of the invention, the closure device comprises an outer casing made of polymeric material. In another particular embodiment of the invention, the outer casing is made of metal.

Further, with reference to the attached figures, possible embodiments of the claimed closure device are described in detail, which, however, do not limit the invention.

The figures show:

Figure 1:
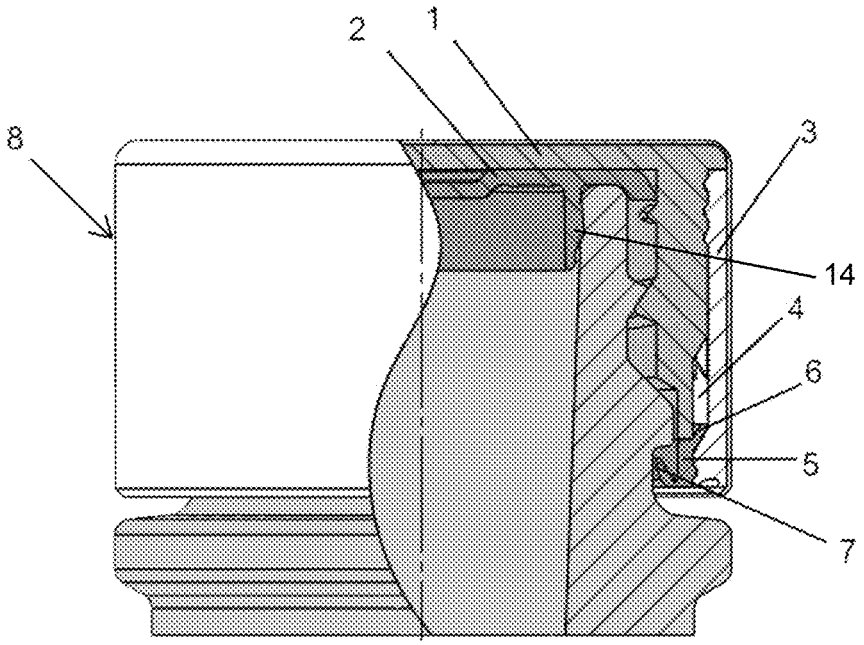
FIG. 1 shows a general view with a partial section of an embodiment of the first embodiment of the closure device in closed state before the first opening.
Figure 2:
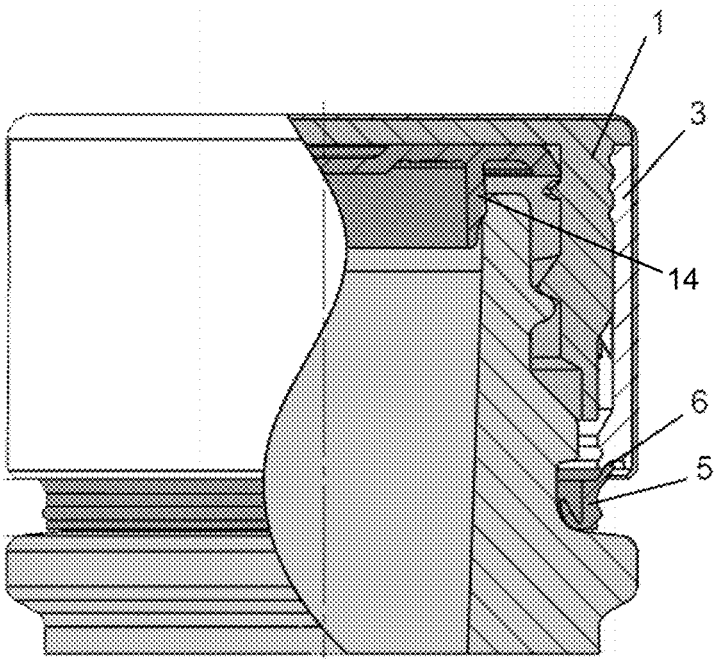
FIG. 2 shows a general view with a partial section of an embodiment of the first embodiment of the closure device according to FIG. 1 in closed state after the first opening.

Reference numbers in the figures indicate the following elements:

1—closed sleeve;
2—gasket;
3—open sleeve;
4—cavity;
5—indicator ring;
6—annular belt;
7—stop;
8—outer casing;
9—outer wall.
10—pour sleeve;
11—base
12—annular protrusion
13—pour spout
14—collar

EXEMPLARY EMBODIMENT OF THE FIRST EMBODIMENT OF THE INVENTION

The closure cap, as shown on FIGS. 1-4, comprises a closed sleeve 1, made with means of fixation on the bottle neck, for example, in the form of a thread, and interacting with the outer surface and/or thread of the bottle neck. The closed sleeve 1 has a sealing means on the bottle neck, made in the form of an annular protrusion on the inner end surface of the said sleeve 1 or in the form of a gasket 2, the diameter of which is sufficient to overlap the bottle finish, and preferably made of foamed polymeric material as a separate part or in the form of an elastic polymeric material gasket with an annular collar 14 placed in the neck of the bottle.

The device also comprises an open sleeve 3 forming a cavity 4 with the closed sleeve, and indicator ring 5 with elastic annular belt 6 bent outward along the upper contour.

The annular belt 6 can be made continuous or discontinuous and, before the first opening of the closure cap, is placed in the cavity 4 between the closed sleeve 1 and the open sleeve 3 in such a way as to be kept from falling out during closing.

The indicator ring 5 can be made with the ability of resting against the annular flange of the bottle, for this reason, stops 7 are made on its inner surface, for example, in the form of a continuous protrusion or abutting tabs.

The device may also comprise an outer casing 8 at least partially enclosing the closed sleeve 1. This provides an increase in the rigidity of the closed sleeve 1, which affects the reliability and security of the closure cap. The ends of the outer casing 8, when made of metal, can be bent under the lower end surface of the closed sleeve 1 and/or open sleeve 3.

The outer casing 8 can be made of metal, such as aluminum, steel foil, etc., in particular by punching, or of polymeric material, in particular by injection molding. During the manufacturing process, coatings and means of identification can be applied to the side and end surfaces of the outer casing 8 by methods, for example, of hot stamping, offset, screen or pad printing, white, colored, transparent or metallized varnishes. The coating can also be applied by spray deposition or vacuum deposition.

Figure 3:
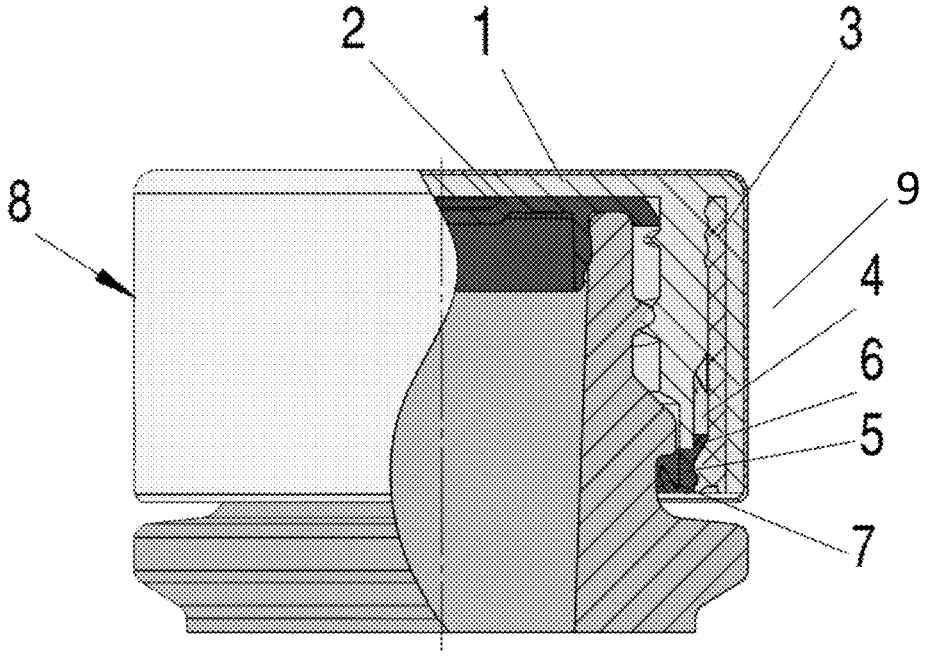
FIG. 3 shows a general view with a partial section of another embodiment of the first embodiment of the closure device in closed state before the first opening.
Figure 4:
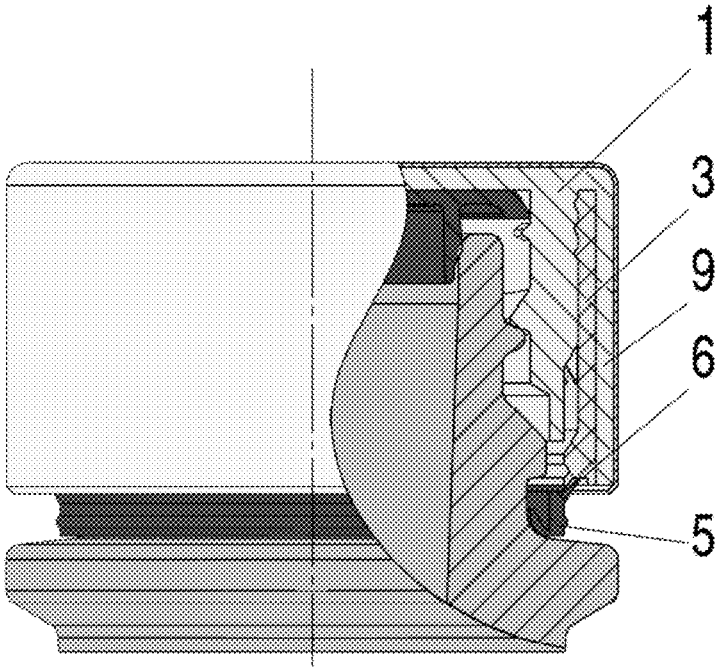
FIG. 4 shows a general view with a partial section of another embodiment of the first embodiment of the closure device according to FIG. 3 in closed state after the first opening.

In a preferred, but not mandatory, embodiment of the invention, the closed sleeve 1 can be provided with an outer wall 9 placed between the outer casing 8 and the open sleeve 3, as shown in FIGS. 3, 4. This allows increasing the rigidity of the open sleeve 3, further preventing the indicator ring 5 from being deliberately reintroduced into its initial position after the first opening of the closure cap.

The closed sleeve 1, the open sleeve 3 and the indicator ring 5 are injection molded from polymer materials such as polypropylene or polyethylene.

The assembly of the finished closure cap is carried out by mutual fixation of the indicator ring 5 and the open sleeve 3, after which the closed sleeve 1 is installed, fixing it relative to the open sleeve 3, wherein a cavity 4 is formed for placing the annular belt 6 of the indicator ring 5 in it.

The claimed closure cap operates as follows.

During the first unscrewing of the closure cap, the closed sleeve 1 together with the open sleeve 3 is separated along the threaded connection from the neck of the bottle. In this case, the indicator ring 5 with the annular belt 6 is released and remains on the neck of the bottle, signaling the first opening. When the bottle is closed again, the annular belt 6 prevents the indicator ring 5 from returning to its initial position due to its abutment against the lower end surface of the open sleeve 3.

The proposed technical solution opens up wide opportunities for providing different options for the appearance of closure caps, and also allows to increase the degree of protection of finished products from counterfeiting and improve the sealing of the closure while maintaining high manufacturability of closure caps in large-scale factory production.

EXEMPLARY EMBODIMENT OF THE SECOND EMBODIMENT OF THE INVENTION

Figure 5:
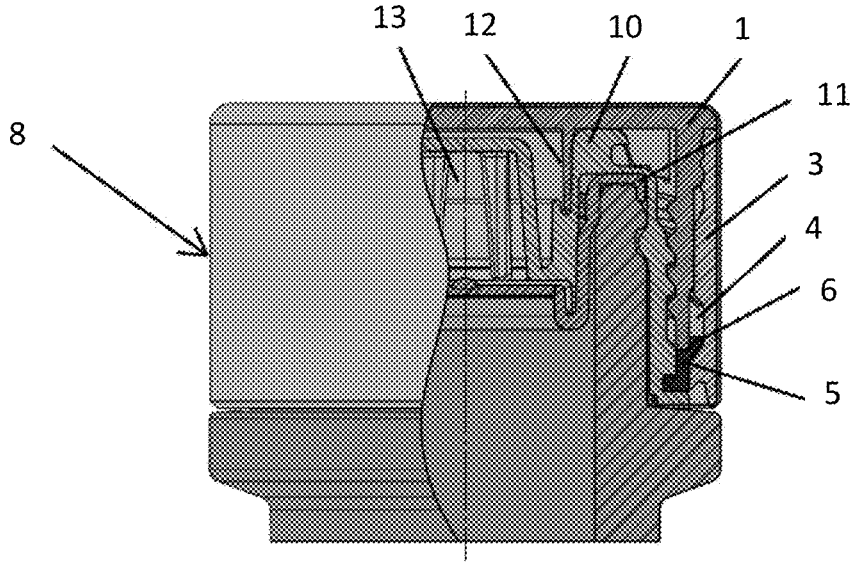
FIG. 5 shows a general view with a partial section of an embodiment of the second embodiment of the closure device in closed state before the first opening.
Figure 6:
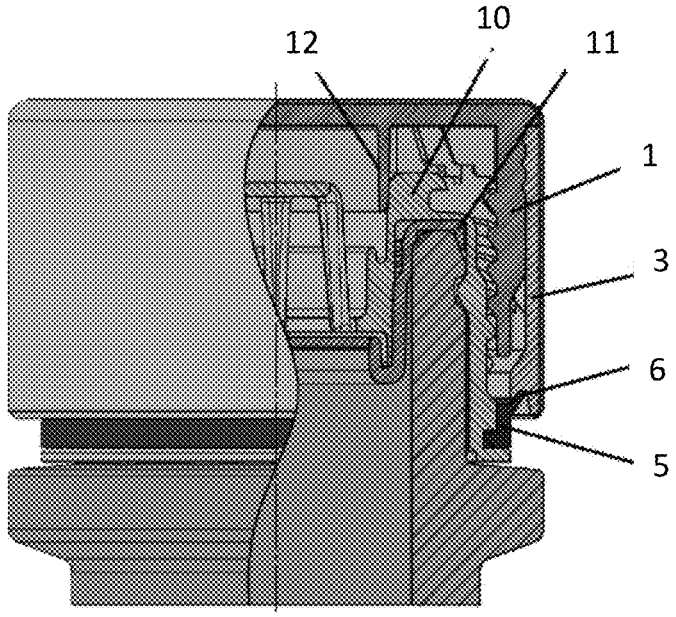
FIG. 6 shows a general view with a partial section of an embodiment of the second embodiment of the closure device according to FIG. 5 in closed state after the first opening.

The closure device, as shown on FIGS. 5-6, comprises a pour sleeve 10, installed on neck of a bottle by means of axial and radial fixation, a closed sleeve 1, made with a means of fixation on the pour sleeve 10, for example, in the form of a thread, and interacting with the outer surface and/or thread of said pour sleeve 10. Additionally, the device comprises a means of sealing the bottle neck, made in the form of a base 11. The base 11 comprises an annular cavity for placing the inner wall of the pour sleeve 10 thus forming a labyrinth seal. Additionally, the device may comprise a sealing means in the form of an annular protrusion 6 on the inner end surface of the pour sleeve 10, placed in the pour spout 13 of the pour sleeve 10 to form a labyrinth seal. Embodiments of the sealing means in the form of a gasket, the diameter of which is sufficient to overlap the bottle finish, and preferably made of foamed polymer material as a separate part or in the form of an elastic polymer material gasket with an annular collar 14 placed in the pour spout 13 of the pour sleeve 10, are possible.

The device also comprises an open sleeve 3 forming a cavity 4 with the closed sleeve, and indicator ring 5 with elastic annular belt 6 bent outward along the upper contour.

The annular belt 6 can be made continuous or discontinuous and, before the first opening of the closure device, is placed in the cavity 4 between the closed sleeve 1 and the open sleeve 3 in such a way as to be kept from falling out during closing.

The indicator ring 5 can be made with the ability of resting against the annular flange of the pour sleeve 10, for this reason, stops are made on its inner surface, for example, in the form of a continuous protrusion or abutting tabs.

The device may also comprise an outer casing 8 at least partially enclosing the closed sleeve 1. This provides an increase in the rigidity of the closed sleeve 1, which affects the reliability and security of the closure device. The ends of the outer casing 8, when made of metal, can be bent under the lower end surface of the open sleeve 3.

The outer casing 8 can be made of metal, such as aluminum, steel foil, etc., in particular by punching, or of polymeric material, in particular by injection molding. During the manufacturing process, coatings and means of identification can be applied to the side and end surfaces of the outer casing 8 by methods, for example, of hot stamping, offset, screen or pad printing, with white, colored, transparent or metallized varnishes. The coating can also be applied by spray deposition or vacuum deposition.

The pour sleeve 10, the closed sleeve 1, the open sleeve 3 and the indicator ring 5 are injection molded from polymer materials such as polypropylene or polyethylene.

The assembly of the finished closure device is carried out by mutual fixation of the indicator ring 5 and the pour sleeve 10, after which the closed sleeve 1 is installed, fixing it relative to the pour sleeve 10, then the open sleeve 3 is installed on the closed sleeve 1, wherein a cavity 4 is formed for placing the annular belt 6 of the indicator ring 5 in it. At the next stage, the base 11 is installed inside the pour sleeve 10. The proposed closure device with all its details is made as one unit, can be transported separately, and is designed to be installed on the neck of a bottle. The closure of the bottle is performed by pressing downwards by means of a closure machine.

The claimed closure device operates as follows.

During the first unscrewing of the closure device, the outer casing 8 together with the closed sleeve 1 and the open sleeve 3 is separated along the threaded connection from the pour sleeve 10. In this case, the indicator ring 5 with the annular belt 6 is released and remains on the pour sleeve 10, signaling the first opening. When the bottle is closed again, the annular belt 6 prevents the indicator ring 5 from returning to its initial position due to its abutment against the lower end surface of the open sleeve 3.

The proposed technical solution opens up wide opportunities for providing different options for the appearance of closure device, and also allows to increase the degree of protection of finished products from counterfeiting and improve the sealing of the closure while maintaining high manufacturability of closure device in large-scale factory production.

The invention claimed is:

1. A closure device comprising an open sleeve fixed on a closed sleeve, sealing means in the form of a gasket tightening the opening of a bottle, installed on a neck of the bottle, and an indicator ring, the closed sleeve and the open sleeve forming a cavity, and the indicator ring is provided with an annular belt placed in said cavity before the first opening, and before the first opening the indicator ring is covered by the open sleeve, and the indicator ring is provided with stops which are made on its inner surface, resting against an annular flange of the bottle, said annular belt being made with the ability to be released from said cavity during the first opening and preventing the return of the indicator ring to its initial position when closing the bottle again.

2. The closure device according to claim 1, the annular belt being one of continuous or discontinuous.

3. The closure device according to claim 1, a gasket diameter is sufficient to cover the bottle neck finish.

4. The closure device according to claim 1, the gasket is formed with an annular collar being placed in the neck of the bottle.

5. The closure device according to claim 1, further comprising an outer casing (8) at least partially enclosing the closed sleeve.

6. The closure device according to claim 5, the outer casing being made of polymeric material.

7. The closure device according to claim 5, the outer casing being made of metal.

8. A closure device for bottle having a neck, comprising a pour sleeve made with the ability to be installed on the neck, an open sleeve fixed on a closed sleeve, the closed sleeve having means of fixation on the pour sleeve, a sealing means in the form of a gasket tightening the opening of a bottle, and an indicator ring, the closed sleeve and the open sleeve forming a cavity, and the indicator ring is provided with an annular belt placed in said cavity before the first opening, and before the first opening the indicator ring is covered by the open sleeve, and the indicator ring is provided with stops which are made on its inner surface, resting against an annular flange of the bottle, said annular belt being made with the ability to be released from said cavity during the first opening and preventing the return of the indicator ring to its initial position when closing the bottle again.

9. The closure device according to claim 8, the sealing means being in the form of a base placed in the neck of the bottle.

10. The closure device according to claim 8, further comprising an outer casing at least partially enclosing the closed sleeve.

11. The closure device according to claim 10, the outer casing being made of polymeric material.

12. The closure device according to claim 10, the outer casing being made of metal.

* * * * *